United States Patent [19]

Wyatt

[11] Patent Number: 4,784,226

[45] Date of Patent: Nov. 15, 1988

[54] DRILLABLE BRIDGE PLUG

[75] Inventor: Mark L. Wyatt, Tulsa, Okla.

[73] Assignee: Arrow Oil Tools, Inc., Tulsa, Okla.

[21] Appl. No.: 53,828

[22] Filed: May 22, 1987

[51] Int. Cl.[4] ..... E21B 33/129

[52] U.S. Cl. ..... 166/376; 166/387; 166/182; 166/184

[58] Field of Search ..... 166/376, 387, 118, 123, 166/124, 131, 135, 138, 140, 179, 181, 182, 184, 188, 192, 196, 216, 217

[56] References Cited

U.S. PATENT DOCUMENTS

| | | | |
|---|---|---|---|
| 2,178,999 | 11/1939 | Scott . | |
| 2,598,340 | 5/1952 | Baker et al. | 166/12 |
| 2,637,402 | 5/1953 | Baker et al. . | |
| 2,703,622 | 3/1955 | Austin . | |
| 2,711,795 | 6/1955 | Ragan | 166/134 |
| 2,713,910 | 7/1955 | Baker et al. | 166/123 |
| 2,737,242 | 3/1956 | Baker | 166/123 |
| 2,966,216 | 12/1960 | Bigelow . | |
| 2,998,073 | 8/1961 | Clark, Jr. et al. . | |
| 3,000,443 | 9/1961 | Thompson . | |
| 3,011,555 | 12/1961 | Clark, Jr. . | |
| 3,024,845 | 3/1962 | Conrad . | |
| 3,036,636 | 5/1962 | Clark, Jr. . | |
| 3,082,824 | 3/1963 | Taylor et al. | 166/134 |
| 3,106,961 | 10/1963 | Bigelow . | |
| 3,131,764 | 5/1964 | Muse et al. . | |
| 3,160,209 | 5/1965 | Bonner . | |
| 3,181,614 | 5/1965 | Brown . | |
| 3,298,437 | 1/1967 | Conrad . | |
| 3,298,440 | 1/1967 | Current | 277/116.2 |
| 3,678,998 | 7/1972 | Cockrell et al. . | |
| 3,695,352 | 10/1972 | McGill | 166/127 |
| 3,749,167 | 7/1973 | Young | 166/134 |
| 4,146,093 | 3/1979 | Horvath et al. | 166/120 |
| 4,388,971 | 6/1983 | Peterson | 166/134 |
| 4,427,063 | 1/1984 | Skinner | 166/134 |
| 4,438,933 | 3/1984 | Zimmerman . | |
| 4,440,233 | 4/1984 | Baugh et al. . | |
| 4,488,595 | 12/1984 | Akkerman . | |
| 4,537,251 | 8/1985 | Braddick . | |
| 4,545,431 | 10/1985 | Fore | 166/183 |
| 4,572,290 | 2/1986 | Clifton . | |
| 4,595,052 | 6/1986 | Kristiansen | 166/123 |
| 4,600,055 | 7/1986 | Durst et al. . | |
| 4,603,743 | 8/1986 | Lindsey, Jr. . | |
| 4,610,300 | 9/1986 | Mullins, II et al. . | |
| 4,611,658 | 9/1986 | Salerni et al. . | |
| 4,627,491 | 12/1986 | Zunkel . | |
| 4,708,202 | 11/1987 | Sukup et al. | 166/376 |

*Primary Examiner*—Jerome W. Massie
*Assistant Examiner*—Terry Lee Melius
*Attorney, Agent, or Firm*—Edgar A. Zarins; Malcolm L. Sutherland; Leon E. Redman

[57] ABSTRACT

A bridge plug having upper and lower slips for anchoring the plug and an elastomeric packing element for sealing within a well casing. The bridge plug may be set either mechanically or through a wireline pressure setting assembly. The small outer diameter of the bridge plug allows for fast run in and the short design and material selection assures a quick drill-out. The lower cone adjacent the lower slip assembly is locked to prevent spinning of the plug during drill out. Pressure equalizing means are provided for equalizing the fluid pressure above and below the plug before drilling out the upper slips.

14 Claims, 1 Drawing Sheet

DRILLABLE BRIDGE PLUG

BACKGROUND OF THE INVENTION

I. Field of the Invention

This invention relates to a bridge plug which may be set by either wireline or mechanical means and, in particular, to a bridge plug made of cast iron which may be quickly drilled out of the casing.

II. Description of the Prior Art

Various bridge plug configurations have been utilized to seal a well casing but generally the most common are bridge plugs of the type having upper and lower anchor slips with an elastomeric packer element positioned about an inner mandrel therebetween. Bridge plugs may be set by either mechanical or wireline means to anchor the slips and compress the packer element into sealing engagement with the casing wall. Once set, the plug can be subject to extreme pressures and temperatures and the plug must be capable of withstanding these conditions without destruction of the seal formed by the packer element. At a later time it may become advantageous to remove the plug in order to continue working the well.

The simplest method of removing a bridge plug is to drill out the plug as the drill bit is run into the casing to further develop the well hole. However, it has been found that bridge plugs having even a minimal amount of steel are difficult to drill during removal and can damage the drill bit. The steel in the structural body of the plug is utilized to provide structural strength to set the tool particularly in the form of a shear stud which screws into the top of the plug. The disadvantage of this configuration is that when the stud is sheared to separate the setting tool from the plug, a small stub of steel remains in the plug which is difficult to drill out.

Past known bridge plugs have also been provided with means for maintaining packer compression independent of that provided by the slips. Such bridge plugs include ratchet mechanisms which maintain the packer in a compressed condition. In most bridge plugs the lock nut or ratchet mechanism is positioned either above the upper slip or inside the upper compression cone. The disadvantage of this design is that the packing element must pass over the threads on the mandrel required for the lock nut to ratchet over and lock into place. When the element passes over these threads, there is a good chance that the packer may be damaged thereby reducing its sealing capability.

SUMMARY OF THE PRESENT INVENTION

The present invention overcomes the disadvantages of the prior known bridge plugs by providing a plug which may be set through wireline or mechanical means yet can be readily drilled out to remove the bridge plug and continue development of the well.

The bridge plug according to the present invention generally comprises upper and lower anchor slips, upper and lower compression cones disposed inwardly of the slips, and an elastomeric packer element disposed therebetween, all of which are mounted to an inner mandrel. Disposed beneath the lower cone is a lock nut which ratchets against threads formed on the mandrel. The mandrel includes a partial bore open to the bottom of the plug and extending upwardly to the approximate position of the upper slips. The upper end of the mandrel is provided with internal and external threaded portions above the break-line adapted to receive a mechanical setting tool or a wireline setting tool. This eliminates the need for a separate shear stud attached to the plug yet allows disconnection of the setting tool by either rotating the tubing string or simply shearing the upper mandrel portion at the break-line. The entire body of the bridge plug is made of cast iron which facilitates drilling out of the plug when removal is necessary.

Minor components, such as incorporated shear pins, may be made of steel or the like since they will fall away upon destruction of the support structure. However, the main structure including the shear stud are made of cast iron.

In the case of wireline setting of the bridge plug, the pressure setting assembly is attached to the outer threads of the upper mandrel and a setting sleeve is utilized to move the slips into contact with the casing and compress the packing element. To disengage the setting assembly the upper mandrel is sheared at the break-point of the mandrel just below the threaded portion. To disengage a mechanical setting assembly, the tubing string is rotated clockwise until the tool releases from the internal left-hand threaded portion of the upper mandrel.

When the bridge plug is drilled out the lower cone is locked into position by the lock nut to prevent spinning of the plug. As drilling continues, the partial bore will be reached before the upper slips are drilled out thereby providing pressure equalizing fluid communication above and below the bridge plug. Drilling continues until the entire bridge plug is destroyed.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
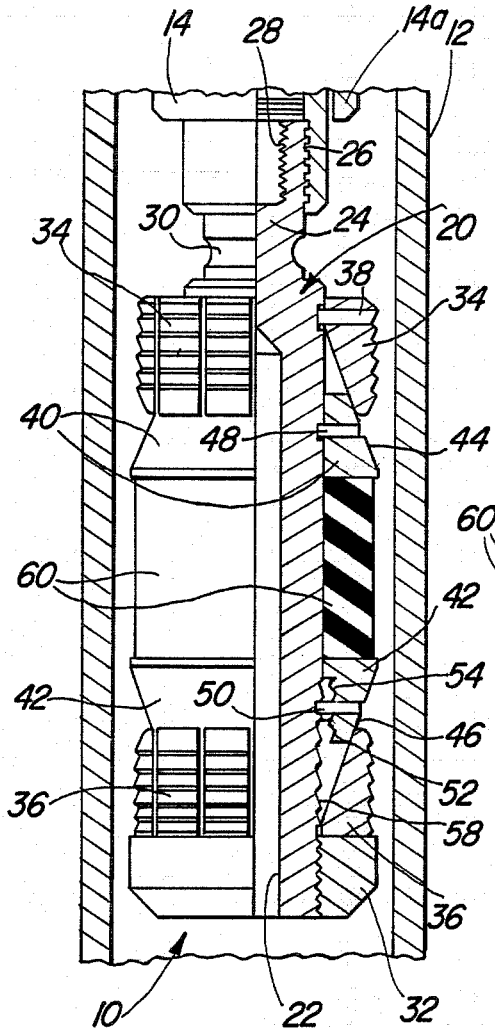
FIG. 1 is a partial cross-sectional perspective of the tool of the present invention run into a well casing.
Figure 2:
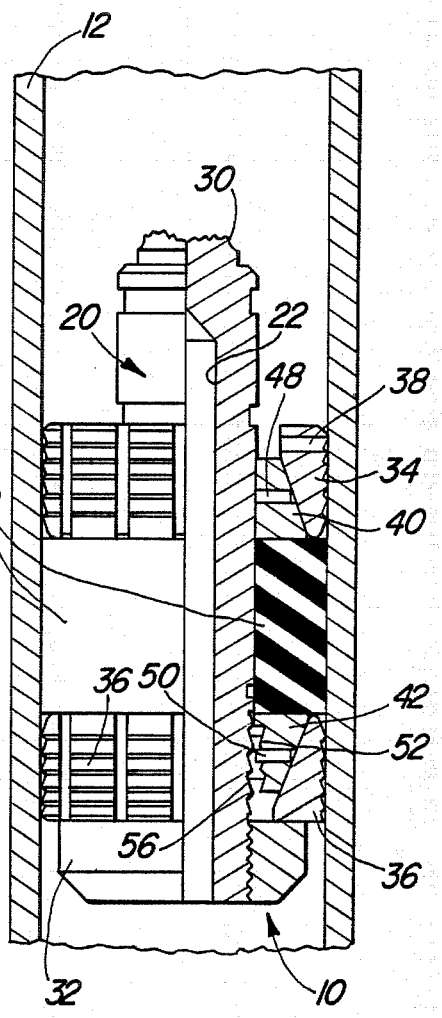
FIG. 2 is a partial cross-sectional perspective of the tool embodying the present invention set within the well casing.

Referring generally to FIGS. 1 and 2 of the drawing there is shown the bridge plug 10 embodying the present invention being run into a well casing 12 (FIG. 1) and set within the well casing 12 (FIG. 2). The bridge plug 10 of the present invention is normally run into the well casing 12 using a setting tool 14 such as the wireline setting tool shown in FIG. 1. Alternatively, the plug 10 may be run and set using a mechanical setting tool as will be more fully described hereinafter.

The bridge plug 10 comprises an inner mandrel 20 which extends the length of the plug 10 and includes a partial axial bore 22 open to the bottom of the plug 10 and an integral connecting stud 24 formed at the upper end of the mandrel 20. The stud 24 facilitates detachable connection of the setting assembly 14 to the bridge plug 10. The stud 24 includes an outer thread portion 26 and an inner thread portion 28. The outer thread portion 26 is adapted to cooperate with a setting tool such as that shown in FIG. 1. Conversely, the inner threads 28 are a reverse or left-handed thread adapted to cooperate with a mechanical setting tool. The inner reverse-thread portion 28 facilitates detachment of the setting tool 14 once the plug 10 is set in the casing 12. The detachable connecting stud 24 is separated from the main portion of the mandrel 20 by an annular shear groove 30 which facilitates quick detachment of the setting tool 14 and connecting stud 24 as will be subsequently described.

The setting components of the bridge plug 10 are mounted to the mandrel 20 so as to be longitudinally movable along the mandrel 20 and engageable with the casing 12. Fixedly mounted to the bottom end of the mandrel 20 is an abutment collar 32 against which the setting components are compressed to set the bridge plug 10. Upper slip 34 and lower slip 36 are mounted to the mandrel 20 as the outer setting components and generally include a plurality of serrations which enage the casing 12 and prevent longitudinal movement of the slips 34 and 36 once set. Lower slip 36 adjacently abuts the collar 32 and expands radially outwardly to engage the casing 12. Upper slip 34 is connected to the mandrel 20 by a first set of shear screws 38 which maintain the position of the upper slip 34 relative to the mandrel 20 until sufficient pressure is applied to shear the screws 38 and expand the slip 34 radially outwardly to engage the casing 12.

Disposed longitudinally inwardly of the slips 34 and 36 are upper compression cone 40 and lower compression cone 42. The compression cones 40 and 42 include sloped surfaces 44 and 46, respectively, which cooperate with the slips 34 and 36 to force the slips radially outwardly into engagement with the casing 12. The upper compression cone 40 is connected to the mandrel by a second set of shear screws 48 while the lower compression cone 42 is connected to the mandrel by a third set of shear screws 50. The three sets of shear screws 38, 48 and 50 will shear under different compression forces in order to provide sequential setting of the components of the bridge plug 10 as will be subsequently described. Furthermore, disposed between the lower compression cone 42 and the mandrel 20 is a lock nut 52 having inner and outer serrations or ratchet threads 54. The outer serrations 54 are adapted to fixedly engage similarly configured serrations formed on the lower compression cone 42. In contrast, the inner serrations 56 are adapted to initially rest upon the mandrel 20 as shown in FIG. 1 and then, as the plug 10 is set, to engage and ratchet across the ratchet threads 58 formed on the lower portion of the mandrel 20. In this manner, the lower compression cone 42 and lower slip 36, once set, are prevented from disengaging the casing 12 by the ratcheting effect of the lock nut 52.

An elastomeric packing element 60 is mounted on the mandrel 20 between the upper slip 34 and cone 40 and the lower slip 36 and cone 42. The packing element 60 is adapted to be deformed into sealing engagement with the casing 12 upon compression of the setting components. Although the packing element 60 is shown and described as being one-piece it is to be understood that a packing element having multiple members is contemplated under the present invention. In either case, the packing element 60 is adapted to provide a fluid-tight seal between the mandrel 20 and the casing 12.

Operation of the bridge plug 10 of the present invention allows for fast run in of the device to isolate sections of the borehole as well as quick and simple drill-out to remove the plug 10. Drill-out of the plug 10 is facilitated by the fact that the mandrel 20 including the integral connecting stud 24, the slips 34 and 36, and the compression cones 40 and 42 are all made of cast iron which is less damaging to the drill bit utilized to drill out such plugs than the steel components found in conventional bridge plugs. Moreover, as the bridge plug 10 of the present invention is drilled out, the differential pressure across the plug 10 is equalized through the axial bore 22 of the mandrel 20 before the upper slips 34 are drilled out. Finally, the positioning of the lock nut 52 on the lower part of the bridge plug 10 prevents damage to the packing element 60 as well as locking the lower compression cone 42 against spinning during drill-out.

The bridge plug 10 is run into the casting to the desired depth on a setting assembly 14. The connecting stud 24 is adatped to receive either a wireline setting tool or a mechanical setting tool. The outer threaded portion 26 of the stud 24 is received within the threaded recess of the setting tool as shown in FIG. 1. Alternatively, the end of a mechanical setting tool (not shown) can be inserted into the female reverse-thread portion 28 of the connecting stud 24. When the bridge plug 10 is run to the desired depth, an outer sleeve 14a which forms a portion of the setting tool 14 is utilized to compress the plug into sealing engagement with the casing wall 12. The sleeve 14a engages the upper slip 14 while pull tension is applied to the mandrel 20. As tension increases, screws 50 will shear allowing lower compression cone 42 to travel beneath the lower slips 36 forcing the slips outwardly in engagement with the well casing 12. At the same time, the cone 42 will move relative to the mandrel such that locking nut 52 will engage the ratchet threads 58 of the mandrel 20. In this manner as additional tension is placed on the plug 10 the lower cone 42 and the lock nut 52 will continue to ratchet along the mandrel 20 but will be prevented from moving upwardly relative to the mandrel thereby maintaining engagement of the lower slips 36. Additionally, by associating the lock nut 52 with the lower compression cone 42, the packing element 60 will not engage the ratchet threads 58 which can damage the underside of the element 60 resulting in a loss of the fluid seal along the mandrel.

As the lower slip 36 is set and the packing element 60 is compressed into sealing engagement with the casing wall 12, additional tension applied to the plug 10 will cause screw 48 to shear thereby freeing upper cone 40. Still more tension will shear screw 38 causing the upper slips 34 to travel along the sloped surface 44 of the upper cone 40 into engagement with the casing 12. The serrated outer surfaces of the slips prevent the slips 34 and 36 from moving longitudinally within the casing 12 which can cause release of the bridge plug 10. With the plug 10 set within the casing 12 the setting assembly 14 can be detached from the bridge plug 10 to leave it within the casing.

The setting assembly 14 is detached from the plug 10 by either of two methods. In the first method, once the plug is set straight pull tension is applied to the stud 24 until the mandrel 20 is broken at the shear groove 30. In the preferred embodiment of the invention, the mandrel 20 is broken when the wireline setting assembly is utilized in conjunction with the bridge plug 10. In the second method of detachment preferably utilized in conjunction with the mechanical setting assembly, the tubing string and setting tool are rotated to disengage from the plug 10. This is accomplished by connecting the mechanical setting tool to the inner left-hand threaded portion of the mandrel and, when desired, simply rotating the tubing string to the right or clockwise to release the setting tool from the plug 10. Thus, the setting tool can be detached from the bridge plug 10 by either breaking the connecting stud 24 or simply rotating the tubing string to disengage the setting tool from the connecting stud 24. Preferably, however, the break method is utilized in conjunction with a wireline setting tool while the rotation method is utilized in conjunction with the mechanical setting tool.

Once the setting tool is detached utilizing either method, no steel material will be left in the bridge plug 10 which can damage the drill bit utilized to drill out the plug. As the bridge plug 10 is drilled whatever remains of the connecting stud 24 and the solid portion of the mandrel 20 above the axial bore 22 will be destroyed. When the drill bit reaches the bore 22 a pressure equalizing fluid passageway will be formed providing fluid communication above and below the bridge plug. This pressure equalization occurs before the upper slips 34 are drilled out thereby preventing movement of the plug 10. The drill bit will continue to move through the bridge plug 10 until it is completely removed, thereby opening the well casing 10. However, as the bridge plug is drilled out, the locking nut 52 will prevent the plug 10 from spinning during drill-out thus ensuring complete removal of the plug.

The foregoing detailed description has been given for clearness of understanding only and no unnecessary limitations should be understood therefrom as some modifications will be obvious to those skilled in the art without departing from the scope and spirit of the appended claims.

I claim:

1. A drillable bridge plug for sealing a well casing using a setting assembly and adapted to be readily drilled out to remove said bridge plug, said bridge plug comprising:

an inner mandrel having detachable means for connecting said bridge plug to the setting assembly formed at the upper end of said mandrel, said mandrel including a partial axial bore open to the bottom of said bridge plug, said partial bore operating as a fluid bypass passageway when said bridge plug is drilled out to provide pressure equalizing fluid communication above and below said bridge plug;

upper slip means and lower slip means mounted on said mandrel and adapted to selectively engage the well casing to anchor said bridge plug;

an elastomeric packing element mounted on said mandrel between said upper slip means and said lower slip means; and upper and lower compression cones mounted on said mandrel, said cones operable to deform said packing element into sealing engagement with the well casing upon setting of said bridge plug;

a lock nut movably mounted on said mandrel adjacent said lower compression cone, said lock nut cooperating with ratchet threads formed on said mandrel and said lower compression cone to maintain compression of said packing element and prevent rotation of said bridge plug as said plug is drilled out;

said inner mandrel including said connecting means, said upper slip means, said lower slip means and said compression cones being made of cast iron wherein said bridge plug may be drilled out of the well casing.

2. The bridge plug as defined in claim 1 wherein said connecting means of said mandrel comprises a shear stud having an outer threaded portion adapted to cooperate with a wireline setting assembly and an inner reverse-thread portion adapted to cooperate with a mechanical setting assembly.

3. The bridge plug as defined in claim 2 wherein said connecting means of said mandrel is integrally formed with said mandrel, said connecting means including a shear groove for selectively detaching said connecting means and the setting assembly from said bridge plug.

4. The bridge plug as defined in claim 2 wherein the setting assembly is detached from said bridge plug by rotating the setting assembly relative to said bridge plug to disconnect the setting assembly from said connecting means.

5. The bridge plug as defined in claim 1 wherein said partial axial bore extends upwardly to a position substantially concentric with said upper slip means thereby forming an upper mandrel portion having no passageway therethrough, said partial bore operating as a fluid bypass passageway when said upper mandrel portion having no passageway is drilled out to provide pressure equalizing fluid communication above and below said bridge plug.

6. A drillable bridge plug for sealing a well casing using a setting assembly and adapted to be readily drilled out to remove said bridge plug from the well casing, said bridge plug being set within the well casing using the setting assembly, said bridge plug comprising:

an inner mandrel having detachable means for connecting said bridge plug to the setting assembly integrally formed at the upper end of said mandrel, said detachable connecting means comprising an outer threaded portion adapted to cooperate with a wireline setting assembly and an inner reverse-thread portion adapted to cooperate with a mechanical setting assembly;

upper slip means and lower slip means mounted on said mandrel and adapted to selectively engage the well casing to anchor said bridge plug; an elastomeric packing element mounted on said mandrel between said upper slip means and said lower slip means;

upper and lower compression cones mounted on said mandrel for selective longitudinal movement relative to said mandrel, said cones operable to deform said packing element into sealing engagement with the well casing; and lock nut ratcheting means mounted on said mandrel adjacent said lower compression cone, said lock nut ratcheting means cooperating with ratchet threads formed on said mandrel and said lower compression cone to maintain compression of said packing element and to prevent rotation of said bridge plug as said plug is drilled out;

said inner mandrel including said integral connecting means, said upper slip means, said lower slip means, and said compression cones being made of cast iron wherein said bridge plug may be drilled out of the well casing;

said mandrel including a partial axial bore open to the bottom of said bridge plug and extending upwardly to a position substantially concentric with said upper slip means thereby forming an upper mandrel portion having no passageway therethrough, said partial bore operating as a fluid bypass passageway when said upper mandrel portion having no passageway is drilled out to provide pressure equalizing fluid communication above and below said bridge plug.

7. The bridge plug as defined in claim 6 wherein said connecting means includes a shear groove formed below said threaded portions to facilitate detachment of said connecting means and the setting assembly from said bridge plug.

8. The bridge plug as defined in claim 6 wherein the setting assembly is detached from said bridge plug by rotating the setting assembly relative to said set bridge plug to disconnect the setting assembly from said connecting means.

9. The bridge plug as defined in claim 6 wherein said upper slip means and said compression cones are detachably connected to said mandrel by a plurality of shear screws.

10. The bridge plug as defined in claim 7 wherein said connecting means comprises an integral shear stud detachably connected to said mandrel at said shear groove.

11. A method of setting and removing a bridge plug within a well casing, said bridge plug adapted to selectively sealingly engage the well casing, comprising the steps of:

running said bridge plug on a setting assembly into said well casing, said bridge plug comprising an inner mandrel having integral means for detachably connecting said bridge plug to the setting assembly and a partial axial bore open to the bottom of said bridge plug, said bridge plug further comprising upper and lower compression slip means and an intermediate elastomeric packing element mounted on said mandrel;

setting said bridge plug using said setting assembly such that said packing element is deformed into sealing engagement with said well casing and said slip means are anchored to said well casing to prevent longitudinal movement of said bridge plug;

detaching said setting assembly from said bridge plug;

drilling out said bridge plug by running a drill bit into said well casing, said bridge plug prevented from rotating during said drilling by a lock nut associated with said lower compression slip means, wherein upon destruction of said mandrel portion above said partial axial bore a pressure equalizing fluid passageway is formed with said partial bore thereby equalizing the fluid pressure above and below said bridge plug, said mandrel including said connecting means and said compression slip means are made of cast iron to facilitate drilling out of said bridge plug without damaging said drill bit.

12. The method as defined in claim 11 wherein said connecting means of said mandrel includes an outer threaded portion adapted to cooperate with a wireline setting assembly, said wireline setting assembly being detached from said bridge plug by breaking said connecting means at a circumferential groove formed on said mandrel below said threaded portion.

13. The method as defined in claim 11 wherein said connecting means of said mandrel includes an inner reverse-thread portion adapted to cooperate with a mechanical setting assembly, said mechanical setting assembly detached from said bridge plug by rotating said setting assembly relative to said connecting means and bridge plug.

14. The method as defined in claim 11 wherein said pressure equalizing fluid passageway is formed prior to drilling out of said upper compression slip means.

* * * * *